US007557707B2

(12) United States Patent
Kumar et al.

(10) Patent No.: US 7,557,707 B2
(45) Date of Patent: Jul. 7, 2009

(54) RFID ENABLED INFORMATION SYSTEMS UTILIZING A BUSINESS APPLICATION

(75) Inventors: Anush Kumar, Seattle, WA (US); Balasubramanian Sriram, Sammamish, WA (US)

(73) Assignee: Microsoft Corporation, Redmond, WA (US)

( * ) Notice: Subject to any disclaimer, the term of this patent is extended or adjusted under 35 U.S.C. 154(b) by 185 days.

(21) Appl. No.: 11/141,619

(22) Filed: May 31, 2005

(65) Prior Publication Data

US 2006/0047545 A1 Mar. 2, 2006

Related U.S. Application Data

(60) Provisional application No. 60/606,577, filed on Sep. 2, 2004, provisional application No. 60/606,281, filed on Sep. 1, 2004.

(51) Int. Cl.
*G08B 13/14* (2006.01)

(52) U.S. Cl. ..... 340/572.1; 340/10.1; 340/10.5

(58) Field of Classification Search ..... 340/572.1, 340/10.1, 10.5
See application file for complete search history.

(56) References Cited

U.S. PATENT DOCUMENTS

| | | | |
|---|---|---|---|
| 5,650,768 | A | 7/1997 | Eswaran |
| 5,910,776 | A | 6/1999 | Black |
| 6,405,261 | B1 | 6/2002 | Gaucher |
| 6,631,363 | B1 | 10/2003 | Brown et al. |
| 6,677,852 | B1 | 1/2004 | Landt |
| 6,732,923 | B2 | 5/2004 | Otto |
| 6,784,802 | B1 | 8/2004 | Stanescu |
| 6,908,034 | B2 | 6/2005 | Alleshouse |
| 6,943,683 | B2 | 9/2005 | Perret |
| 7,155,305 | B2 | 12/2006 | Hayes et al. |
| 7,204,409 | B2 | 4/2007 | Kumar et al. |
| 7,267,275 | B2 | 9/2007 | Cox et al. |
| 2002/0059471 | A1 | 5/2002 | Sanghvi et al. |
| 2002/0070865 | A1 | 6/2002 | Lancos et al. |

(Continued)

FOREIGN PATENT DOCUMENTS

| | | |
|---|---|---|
| WO | WO 03/102845 | 7/2003 |

(Continued)

OTHER PUBLICATIONS

European Search Report dated May 11, 2006, mailed May 12, 2006 for European Patent Application No. EP05107744, 9 pages.

(Continued)

*Primary Examiner*—Toan N Pham
*Assistant Examiner*—Travis R Hunnings
(74) *Attorney, Agent, or Firm*—Workman Nydegger

(57) ABSTRACT

The subject invention provides a system and/or a method that facilitates extending data within an RFID network to a business application. An interface can receive real-time RFID data from a process with at least one device collection within the RFID network. An integration component can seamlessly expose such real-time RFID data to a business application to achieve a critical business function in real-time. The business application can be associated to a business network that connects applications within a single organization and/or connects applications in different organizations. Moreover, the integration component can allow the business application to manipulate the RFID network based at least in part upon the real-time output.

15 Claims, 10 Drawing Sheets

U.S. PATENT DOCUMENTS

| | | | | |
|---|---|---|---|---|
| 2002/0170952 | A1 | 11/2002 | Alsafadi et al. | |
| 2003/0135576 | A1 | 7/2003 | Bodin | |
| 2003/0144926 | A1 | 7/2003 | Bodin et al. | |
| 2003/0225928 | A1 | 12/2003 | Paul | |
| 2003/0227392 | A1* | 12/2003 | Ebert et al. | 340/825.49 |
| 2004/0046642 | A1 | 3/2004 | Becker et al. | |
| 2004/0070491 | A1 | 4/2004 | Huang et al. | |
| 2004/0111335 | A1 | 6/2004 | Black et al. | |
| 2004/0193641 | A1 | 9/2004 | Lin | |
| 2004/0215667 | A1 | 10/2004 | Taylor et al. | |
| 2005/0062603 | A1 | 3/2005 | Fuerst et al. | |
| 2005/0092825 | A1 | 5/2005 | Cox et al. | |
| 2005/0150952 | A1 | 7/2005 | Chung | |
| 2005/0150953 | A1 | 7/2005 | Alleshouse | |
| 2005/0237194 | A1 | 10/2005 | VoBa | |

FOREIGN PATENT DOCUMENTS

| | | |
|---|---|---|
| WO | 03102845 | 12/2003 |
| WO | WO 2005078633 | 8/2005 |

OTHER PUBLICATIONS

European Search Report dated Mar. 9, 2006, mailed Mar. 27, 2006 for European Patent Application Serial No. EP05107744, 7 pages.
European Search Report dated Oct. 4, 2006 and mailed Apr. 11, 2006 for EP 05108005, 9 pages.
European Search Report dated Mar. 9, 2006 mailed Mar. 22, 2006 for European Patent Application Serial No. EP05107794, 7 Pages.
Anonymous: "The Sun Global RFID Betwork Vision: Connecting Businesses at the Edge of Network" Internet Article, Jul. 2004, http://www.sun.com/software/solutions/rfid/Sun_RFIS_Vision_rla.pdf.
U.S. Appl. No. 11/025,702, filed Feb. 18, 2005, Kumar et al.
U.S. Appl. No. 11/061,337, filed Mar. 1, 2005, Kumar et al.
U.S. Appl. No. 11/069,459, filed Feb. 18, 2004, Kumar et al.
U.S. Appl. No. 11/061,356, filed May 31, 2005, Kumar et al.
U.S. Appl. No. 11/141,619, filed May 31, 2005, Kumar et al.
U.S. Appl. No. 11/140,726, filed May 31, 2005, Kumar et al.
U.S. Appl. No. 11/141,533, filed May 31, 2005, Agarwal et al.
European Search Report dated Oct. 2, 2006, mailed Feb. 10, 2006 for European Patent Application Seial No. 05107796, 6 pages.
Tsetsos, et al. "Commerical Wireless Sensor Networks: Technical and Business Issues" Proceedings of the Second Annual Conference on Wireless On-Demand Network Systems and Services (Jan. 19-21, 2005) 8 pages.
Branch, et al. "Sentire: A Framework for Building Middleware for Sensor and Actuator Networks" Proceedings of the Third International Conference on Pervasive Computing and Communications Workshops Mar. 8, 2005) pp. 396-400.
Harrison, et al. "Information Management in the Product Lifecycle-the Role Networked RFID" Proceedings of the Second IEE International Conference (Jun. 24, 2004) pp. 507-512.
Bornhovd, et al. "Integrating Smart Items with Business Processes An Experience Report" Proceedings of the Thirt-Eighth Hawaii International Conference on System Science (Jan. 3, 2005) 8 pages.
Ganesh, et al. "Web Services and Multi-Channel Integration: A Proposed Framework" Proceedings of the IEEE International Conference on Web Services (Jul. 6, 2004) 8 pages.
European Search Report dated Feb. 6, 2006, mailed Feb. 6, 2006 for European Patent Application Seial No. 05107826, 7 pages.
Ortiz. "An Introduction to Java Card Technology -Part 1" http://developers.sun.com/techtopics/mobility/javacard/articles/javacard1/> last viewed Dec. 19, 2005, 14 pages.
Chen. "Understanding Java Card 2.0" URL:.com//javaworld/jw-03-1998/jw-03-javadev_p.html> last viewed Dec. 19, 2005, 12 pages.
IBM "alpha Works: RFID Device Development Kit: Overview" http://www/alphaworks.ibm.com/tech/rfiddevice last viewed Nov. 7, 2005, 1 page.
Alien "ALR-9800 Enterprise RFID Reader" http://www.alientechnology.com/docs/AT_DS_9800_v3_WEB.pdf last viewed Nov. 17, 2005, 4 pages.
European Search Report dated Feb. 7, 2006; mailed Feb. 7, 2006 for PCT Application Serial No. 05 10 8001; 7 pages.
U.S. Appl. No. 11/061,356, filed Feb. 18, 2005, Kumar et al.
U.S. Appl. No. 11/140,726, filed May 31, 2005, Agarwal et al.
U.S. Appl. No. 11/141,533, filed May 31, 2005, Kumar et al.
U.S. Appl. No. 11/025,702, filed Dec. 29, 2004, Kumar et al.
U.S. Appl. No. 11/061,337, filed Feb. 18, 2005, Kumar et al.
U.S. Appl. No. 11/069,459, filed Mar. 1, 2005, Kumar et al.
Floerkemier, et al. "PML Core Specification 1.0" Sep. 13, 2003, Auto-ID Center, Version 1.0, 48 pages.

* cited by examiner

RFID ENABLED INFORMATION SYSTEMS UTILIZING A BUSINESS APPLICATION

CROSS-REFERENCE TO RELATED APPLICATION(S)

This application claims the benefit of U.S. Provisional Patent Application Ser. No. 60/606,281 filed on Sep. 1, 2004, entitled "SYSTEM AND METHODS THAT FACILITATE RFID SERVER PROGRAMMING MODEL AND API'S," and U.S. Provisional Patent Application Ser. No. 60/606,577 filed on Sep. 2, 2004, entitled "FACILITATE RFID SERVER PROGRAMMING MODEL AND API'S." This application is also related to co-pending U.S. patent application Ser. Nos. 11/069,459, 11/025,702, 11/061,356, and 11/061,337 filed on Mar. 1, 2005, Dec. 29, 2004, Feb. 18, 2005, and Feb. 18, 2005, respectively. The entireties of these applications are incorporated herein by reference.

BACKGROUND OF THE INVENTION

Many retail, manufacture, and distribution establishments are applying different and innovative operating methods to increase efficiency. These establishments can monitor store inventory to facilitate optimizing supply and demand relating to consumers. One aspect of maximizing profit hinges on properly stocking inventory such that replenishment occurs in conjunction with exhaustion of goods and/or products. For example, a retailer selling a computer and/or a VCR, must stock the computer in relation to its consumer sales, and the VCR in relation to its consumer sales. Thus, if the computer is in higher demand (e.g., more units sold) than the VCR, the retailer can stock the computer more frequently in order to optimize supply and demand, and in turn, profit. Monitoring inventory and associated sales can be a complex task, wherein product activity is comparable to a black box since inner workings are unknown; yet monitoring products is a crucial element in inventory/product efficiency.

Automatic identification and data capture (AIDC) technology, and specifically, Radio Frequency Identification (RFID) has been developed based at least upon the need to cure deficiencies of typical monitoring systems and/or methodologies (e.g., barcode readers, barcodes, and/or UPCs). RFID is a technique of remotely storing and retrieving data utilizing RFID tags. Since RFID systems are based upon radio frequency and associated signals, numerous benefits and/or advantages precede traditional techniques in monitoring products. RFID technology does not require a line of sight in order to monitor products and/or receive signals from RFID tags. Thus, no manual scan is necessary wherein the scanner is required to be in close proximity of the target (e.g., product). Yet, range is limited in RFID based upon radio frequency, RFID tag size, and associated power source. Additionally, RFID systems allow multiple reads within seconds providing quick scans and identification. In other words, an RFID system allows a plurality of tags to be read and/or identified when the tags are within a range of an RFID reader. The capability of multiple reads in an RFID system is complimented with the ability of providing informational tags that contain a unique identification code to each individual product.

Moreover, RFID systems and/or methodologies provide real-time data associated to a tagged item. Real-time data streams allow a retailer, distributor, and/or manufacturer the ability to monitor inventory and/or products with precision. Utilizing RFID can further facilitate supplying products on a front-end distribution (e.g., retailer to consumer) and a back-end distribution (e.g., distributor/manufacturer to retailer). Distributors and/or manufacturers can monitor shipments of goods, quality, amount, shipping time, etc. In addition, retailers can track the amount of inventory received, location of such inventory, quality, shelf life, etc. The described benefits demonstrate the flexibility of RFID technology to function across multiple domains such as, front-end supply, back-end supply, distribution chains, manufacturing, retail, automation, etc.

An RFID system consists of at least an RFID tag and an RFID transceiver. The RFID tag can contain an antenna that provides reception and/or transmission to radio frequency queries from the RFID transceiver. The RFID tag can be a small object, such as, for example, an adhesive sticker, a flexible label and integrated chip, etc. There are typically four different frequencies the RFID tags utilize: low frequency tags (between about 125 to 134 kilohertz), high frequency tags (about 13.56 megahertz), UHF tags (about 868 to 956 megahertz) and Microwave tags (about 2.45 gigahertz).

In general, an RFID system can include multiple components: tags, tag readers (e.g., tag transceivers), tag writers, tag-programming stations, circulation readers, sorting equipment, tag inventory wands, etc. Such RFID systems can collect and/or accumulate an immense amount of data. Although statistical analysis of such data can be useful, the collected data is more useful and powerful when integrated into existing back-end applications and/or processes in real-time and/or near real-time to invoke a decision. Moreover, collected data can be utilized to incorporate decisions made by such back-end applications and/or processes in order to react to a change within such systems.

SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

The subject invention relates to systems and/or methods that facilitate integrating at least one existing business application into an RFID network, wherein the RFID network can be a collection of devices that form a sub-system based at least in part upon a process, a location, an event, and/or functionality. By integrating the business application to the RFID network, real-time data can be exposed to such applications to achieve business functions and/or outputs in real-time. The business application can be, but is not limited to, a back end application, an existing business application, a line of business (LOB) application (e.g., accounting, supply chain management, resource planning, . . . ), a business activity monitoring (BAM) application, etc. The real-time data can be collected by a device within the RFID network, wherein the device can be, for instance, an RFID reader, an RFID writer, an RFID printer, a printer, a reader, a writer, an RFID transmitter, an antenna, a sensor, a real-time device, an RFID receiver, a real-time sensor, a device extensible to a web service, and a real-time event generation system.

In addition to exposing the real-time data to achieve real-time outputs from the business application, the integration component can expose a business network to such real-time data. The business network can be an application integration product to unit disparate applications into a coherent whole by connecting applications within a single organization, and/ or connecting applications in different organizations. Moreover, the business network can include a plurality of business applications, wherein such real-time data can be exposed to provide accurate and real-time business functions and/or outputs.

The integration component further provides a manipulation and/or creation of a process within the RFID network based at least in part upon the real-time output and/or business function. By utilizing the real-time data within such business applications and/or business networks, the real-time outputs can provide accurate data to invoke manipulations and/or creations to the RFID network and/or a process within the RFID network. The manipulation can be, for instance, an edit, a modification, a delete, a move, etc. to the RFID network, processes, and/or any entity therewith.

In accordance with one aspect of the subject invention, the integration component can include an analyzer component to analyze data associated with the RFID network, the business network, and/or the business application to determine a particular association with a target destination. Based at least in part upon the analysis, a router component can direct such data to a target destination accordingly. For example, real-time data can be analyzed to be associated with a particular business application on a specific business network, wherein the router component can direct such data accordingly.

In accordance with another aspect of the subject invention, a transform component can format data into a particular format suitable for the target destination. In other words, the transform component can convert any data associated with the RFID network and/or the business network into a suitable and/or compatible format for the target destination within the RFID network and/or the business network. Moreover, the transform component can convert to and from any suitable computer language such as, but is not limited to, C#, extensible markup language (XML), and structured query language (SQL).

In accordance with still another aspect, the integration component can further include a schema component that can utilize pre-installed schemas relating to input messages and/or output messages. Furthermore, the schema component can employ a message schema that can be a type of message that the business network can send out and the RFID network recognizes and/or applies. Although the schema component provides the use of schema for such recognition and application, it is to be appreciated that any suitable protocol can be employed. The schema component can further create a schema utilized by the integration component.

In accordance with another aspect of the subject invention, the integration component can include an RFID mapper component that enables straight through message type scenarios. The RFID mapper component can utilize an input schema and/or output schema to invoke straight through messaging scenarios for request-response type operations with the business application (e.g., back end line of business (LOB) systems, business activity monitoring, etc.). Moreover, the RFID mapper can invoke any suitable mapping technique associated with data related to the business network and/or the RFID network. The RFID mapper component can take, for instance, an RFID tag event (e.g., a tag read, a tag read error, a device up event, a device down event, and a management event, etc.) and create a message related to the process (e.g., shipping and/or receiving). In other aspects of the subject invention, methods are provided that facilitate integrating at least one existing business application into an RFID network.

The following description and the annexed drawings set forth in detail certain illustrative aspects of the invention. These aspects are indicative, however, of but a few of the various ways in which the principles of the invention may be employed and the subject invention is intended to include all such aspects and their equivalents. Other advantages and novel features of the invention will become apparent from the following detailed description of the invention when considered in conjunction with the drawings.

DESCRIPTION OF THE INVENTION

Figure 1:
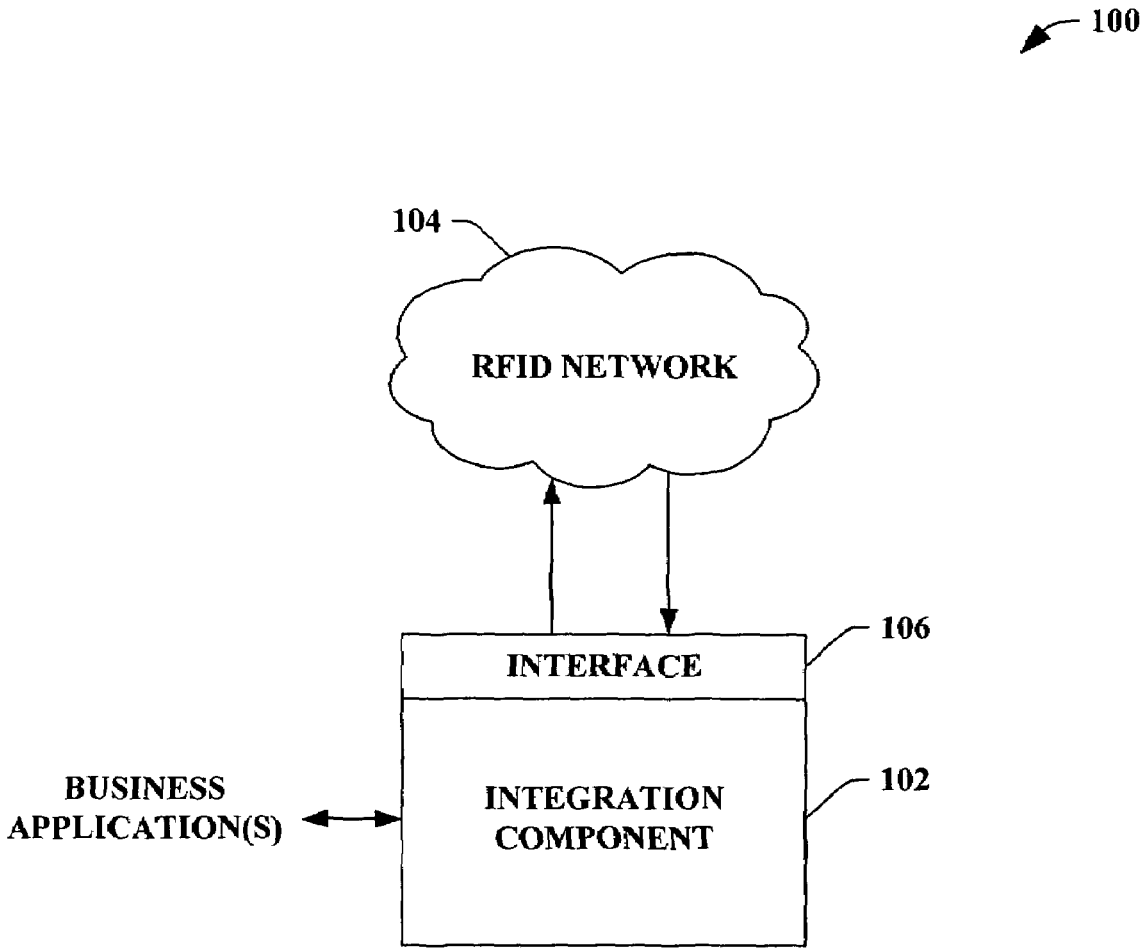
FIG. 1 illustrates a block diagram of an exemplary system that facilitates integrating at least one existing business application into an RFID network.

As utilized in this application, terms "component," "system," "interface," and the like are intended to refer to a computer-related entity, either hardware, software (e.g., in execution), and/or firmware. For example, a component can be a process running on a processor, a processor, an object, an executable, a program, and/or a computer. By way of illustration, both an application running on a server and the server can be a component. One or more components can reside within a process and a component can be localized on one computer and/or distributed between two or more computers.

The subject invention is described with reference to the drawings, wherein like reference numerals are used to refer to like elements throughout. In the following description, for purposes of explanation, numerous specific details are set forth in order to provide a thorough understanding of the subject invention. It may be evident, however, that the subject invention may be practiced without these specific details. In other instances, well-known structures and devices are shown in block diagram form in order to facilitate describing the subject invention.

Now turning to the figures, FIG. 1 illustrates a system 100 that facilitates integrating at least one existing business application into an RFID network. An integration component 102 can seamlessly integrate at least one business application into an RFID network 104, wherein the business application can utilize data associated with such RFID network 104 in real-time. The integration component 102 can receive raw data related to at least one device within the RFID network 104. For instance, the device within the RFID network 104 can be, but is not limited to an RFID reader, an RFID writer, an RFID printer, a printer, a reader, a writer, an RFID transmitter, an antenna, a sensor, a real-time device, an RFID receiver, a real-time sensor, a device extensible to a web service, and a real-time event generation system. The integration component 102 allows the seamless implementation of data from a process within the RFID network 104 with at least one business application. For instance, the business application can be any existing back end application that achieves a critical business function such as, but not limited to, demand planning, forecasting, controlling inventory, etc.

In one example, the RFID network 104 can include at least one RFID device that is associated with at least one RFID process. It is to be appreciated that the RFID process can utilize any suitable number of RFID devices within the RFID network 104. An RFID process can be related to a particular RFID sub-system (e.g., an RFID server, RFID network, etc.) that is an uber or high-level object that forms together various entities to create a meaningful unit of execution. The RFID process can be an outbound process (e.g., pick, pack, shipping scenario, etc.), a manufacturing process, a shipping process, a receiving process, tracking, data representation, data manipulation, data application, security, . . . . Additionally, the RFID process can include an RFID device service, a tag read, an event, a tag write, a device configuration, a geographic tracking, a number count, etc. It is to be appreciated that the process can have raw data collected via at least one device associated with the RFID network 104, wherein such raw data can be received by the integration component 102 to allow the business application to incorporate such data to achieve a critical business function.

The integration component 102 can integrate any suitable business application to seamlessly utilize data associated with the RFID network 104 that is collected by at least one device. The business application can be, but is not limited to, a back end application, an existing business application, a line of business (LOB) application (e.g., accounting, supply chain management, resource planning, . . . ), a business activity monitoring (BAM) application, etc. It is to be appreciated that the integration component 102 can further incorporate a business network (not shown), wherein the business network can unite separate business applications into a coherent whole.

In yet another example, the integration component 102 can allow the business application to manipulate and/or create a process within the RFID network 104 based at least in part upon analysis and/or business functions associated to the business application and/or business network. For example, by utilizing the real-time raw data, the business application can edit an existing process within the RFID network 104 to enhance productivity and/or create a new process within the RFID network 104. In one example, the business application can be related to inventory control, wherein the raw data received from the RFID network 104 can provide inventory data in real-time. If the business application utilizes the real-time data to determine a defective product, a new process to recall such products can be invoked.

The system 100 further includes an interface component 106, which provides various adapters, connectors, channels, communication paths, etc. to integrate the integration component 102 into virtually any operating and/or database system(s). In addition, the interface component 106 can provide various adapters, connectors, channels, communication paths, etc., that provide for interaction with the integration component 102, and the RFID network 104. It is to be appreciated that although the interface component 106 is incorporated into the integration component 102, such implementation is not so limited. For instance, the interface component 106 can be a stand-alone component to receive or transmit data in relation to the system 100. In particular, the interface component 106 can receive any data relating to a device that is associated with an RFID process in the RFID network 104. For instance, the interface component 106 can receive raw collected data, an RFID process related data, and/or any data collected from the device.

Figure 2:
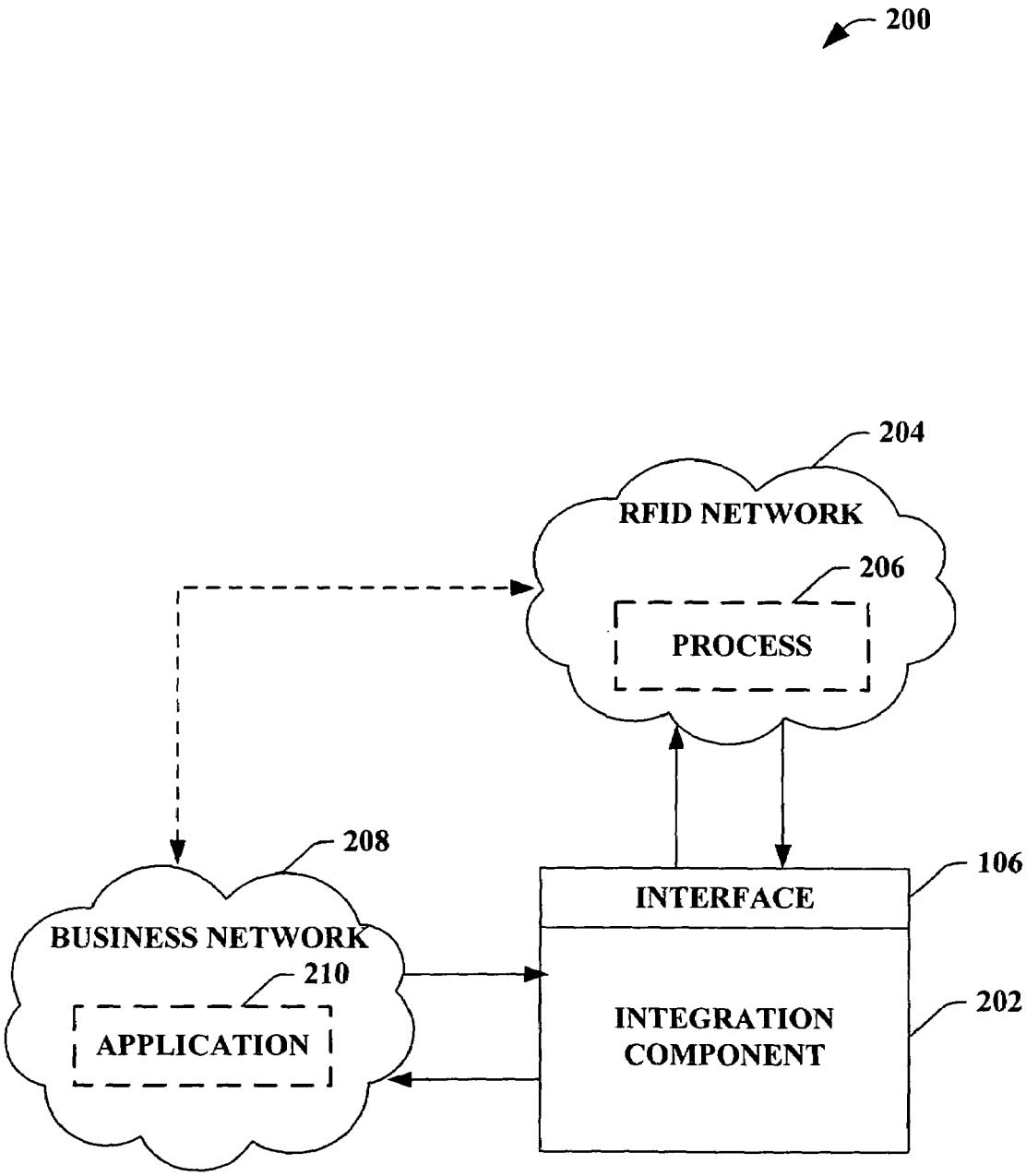
FIG. 2 illustrates a block diagram of an exemplary system that facilitates utilizing a business application with an RFID network to achieve a critical business function.

FIG. 2 illustrates a system 200 that facilitates utilizing a business application with an RFID network to achieve a critical business function. An integration component 202 can provide seamless interaction of at least one application 210 instantiated within a business network 208 with a process 206 within an RFID network 204. It is to be appreciated that the business network 208 and the RFID network 204 can include a plurality of applications and processes respectively and the subject invention is not limited to such depiction of the application 210 and the process 206. The application can be, but is not limited to, a back end business application, an existing business application, a line of business (LOB) application (e.g., accounting, supply chain management, resource planning, . . . ), a business activity monitoring (BAM) application, etc. The integration of the application 210 with the process 206 allows the execution of at least one business function in real-time utilizing any data collected by and/or related to the process 206. In other words, the integration component 202 can allow the application 210 to seamlessly integrate data related to the process 206 to facilitate providing a business function output related to the application 210 within the business network 208.

The RFID network 204 can include at least one device (e.g., an RFID reader, an RFID writer, an RFID printer, a printer, a reader, a writer, an RFID transmitter, an antenna, a sensor, a real-time device, an RFID receiver, a real-time sensor, a device extensible to a web service, a real-time event generation, etc.) that is associated with at least one RFID process. The RFID network 204 can include various subsystems based at least in part upon location, function, and/or process. For example, an RFID network 204 can be two groups and/or collections of devices, one at a shipping door and another at a receiving door. Such RFID network 204 can further include a process associated with each groups and/or collection of devices based at least in part upon the group and/or collection name, location, and/or process name. For instance, the process can be a shipping process that is related to the devices at the shipping door, wherein the devices can collect data at such location. Similarly, another process can be a receiving process that is related to the devices at the receiving door, wherein the devices can collect data at such location. Thus, the integration component 202 can automatically integrate any suitable application 210 which can utilize such real-time data from processes within the RFID network 204 to produce the application 210 output.

The process 206 is an uber and/or high-level object that can provide a meaningful unit of execution. For instance, the process 206 can be a shipping process that represents multiple devices at various dock doors working together to perform tag reads, filtering, read enrichment, alert evaluation, and data storage in a sink for a host application to retrieve/process. In another example, the process 206 can execute a manufacturing process, wherein devices are configured to read as well as write dependent upon a location. Moreover, additional functions such as filtering, enriching, etc. can be implemented at the location. In yet another example, the process 206 can write to a tag process, wherein a tag can be written in real-time based at least upon an input. The write process can also check if the write succeeded by reading and passing data back to the host.

The business network 208 can be an integration server product that enables the development, deployment, and/or management of an integrated business process and/or extensible markup language (XML) based Web service. The business network 208 can unite separate applications into a coherent whole, wherein a deep integration between messaging, orchestration, security, and support for industry standards can be provided. Furthermore, the business network 208 can provide, but is not limited to providing, a business activity service, a human workflow service, and/or a business activity monitoring framework that enables interaction with business processes. The business network 208 can further connect applications within a single organization (e.g., commonly referred to as enterprise application integration (EAI)), and/or connect applications in different organizations (e.g., referred to as business to business (B2B) integration).

In one example, the business network 208 can enable the creation of a business process that spans multiple applications by providing: 1) a manner to specify the business process; and 2) a technique for communicating between applications that such business processes utilize. In this example, the business network 208 can implement a business process which includes one or more orchestrations, wherein the orchestration consists of executable code. For instance, an orchestration can be created by graphically organizing a defined group of shapes to express the conditions, loops, and other behavior of the business process. In another example, the business network 208 can utilize a business rules engine to provide the expression of rules in a business process. It is to be appreciated that each orchestration creates a subscription to indicate the kinds of messages received therewith. A message can be received by an adapter, wherein a pipeline can transform the message into a particular format (e.g., XML). Such formatted message can be stored into a database, wherein such messages can be dispatched to a target orchestration to partake in an action respective to the business process. The result of such process can be another message, typically saved in the database. The resultant message can then be processed by a send pipeline that can convert and/or format the message from the internal format (e.g., XML) to a format particular to a destination and sent to such destination via an adapter. The above is one example of the business network 208 and is not to be seen as a limitation on the subject invention.

Furthermore, the integration component 202 allows the application 210 to manipulate the process 206 based at least in part upon the output associated with such application 210 (as represented by a dotted line in FIG. 2). In other words, the data can be incorporated into the business network 208 to be utilized by various applications 210 to produce a particular business function and/or output. Based at least upon such business function and/or output, the application 210 can manipulate the process 206 within the RFID network 204. It is to be appreciated that the manipulation can be, but is not lmited to, editing an existing process 206, creating a new process within the RFID network 204, and/or any combination thereof. For instance, the application 210 can determine a list of products to be recalled, wherein based on such output the process 206 can be manipulated to identify the products identified on the list of products to recall.

Figure 3:
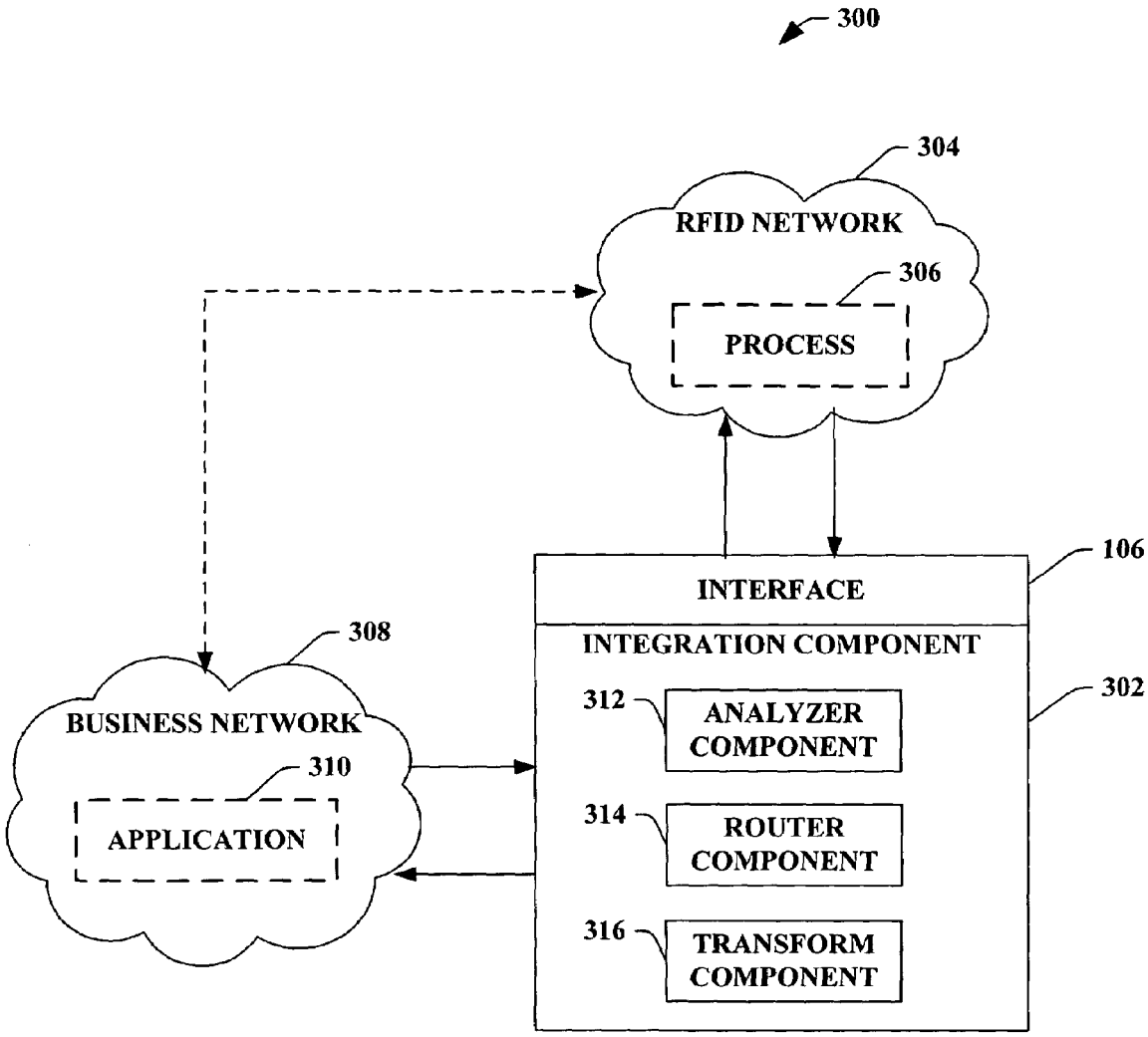
FIG. 3 illustrates a block diagram of an exemplary system that facilitates utilizing and/or managing collected data associated with an RFID network in conjunction with a business network.

FIG. 3 illustrates a system 300 that facilitates utilizing and/or managing collected data associated with an RFID network in conjunction with a business network. An integration component 302 can integrate a business network 308 and/or an application 310 into an RFID network 304 containing at least one process 306 that collects data. The business network 308 can implement such collected data to facilitate executing business functions associated with the business network 308 and/or the application 310. Additionally, the integration component 302 can provide the business network 308 and/or the application 310 to manipulate the RFID network 304 and/or process 306 based at least in part upon outputs produced from the utilization of data incorporated therewith. It is to be appreciated that the integration component 302, the RFID network 304, and the business network 308 can be substantially similar to the integration component 202, 102, the business network 208, and the RFID network 204, 104 of FIGS. 2 and 1 respectively.

The integration component 302 can include an analyzer component 312 that can analyze data received from the RFID network 304, from the business network 308, to the RFID network 304, and to the business network 308. The analyzer component 312 can analyze data received by the RFID network via the interface 106, wherein such data can be determined to be associated to a particular business network 308 and/or application 310. For example, the process 306 can collect data associated to various devices, wherein the analyzer component 312 can analyze such data to determine what business network 308 and/or application 310, if any, can utilize the data to facilitate achieving a critical business function associated therewith. In another example, the analyzer component 312 can analyze a message and/or a manipulation from the business network 308 and/or application 310 to invoke upon the RFID network 304 and/or process 306.

The integration component 302 can further include a router component 314 that can direct data to a target destination accordingly. In other words, the router component 314 provides guidance in distribution of data, messages, and the like. The data received from the RFID network 304 can be routed and/or distributed to the target destination within the business network 308 and/or the application 310. Furthermore, the router component 314 can direct a message, a manipulation, data, and the like to the target destination within the RFID network 304 and/or process 306. It is to be appreciated that the router component 314 can distribute data, messages, commands, and the like based at least in part upon the analyzer component 312, however, the subject invention is not so limited.

The integration component 302 can invoke a transform component 316 that can format data into a particular format suitable for the target destination. In other words, the transform component 316 can convert any data associated with the RFID network 304 and/or the business network 308 into a suitable and/or compatible format for the target destination within the RFID network 304 and/or the business network 308. For example, the transform component can transform data to and from any suitable computer language such as, but is not limited to, C#, extensible markup language (XML), structured query language (SQL), and hypertext markup language (HTML). In one example, the transform component 316 can utilize a data store (not shown) to provide storage for various data, commands, messages, and the like that is compatible with at least one of the business network 308 and/or the RFID network 304. Although incorporated into the transform component 316, it is to be appreciated that the transform component 316 can be a stand-alone component, incorporated into the integration component 302, and/or any combination thereof.

Figure 4:
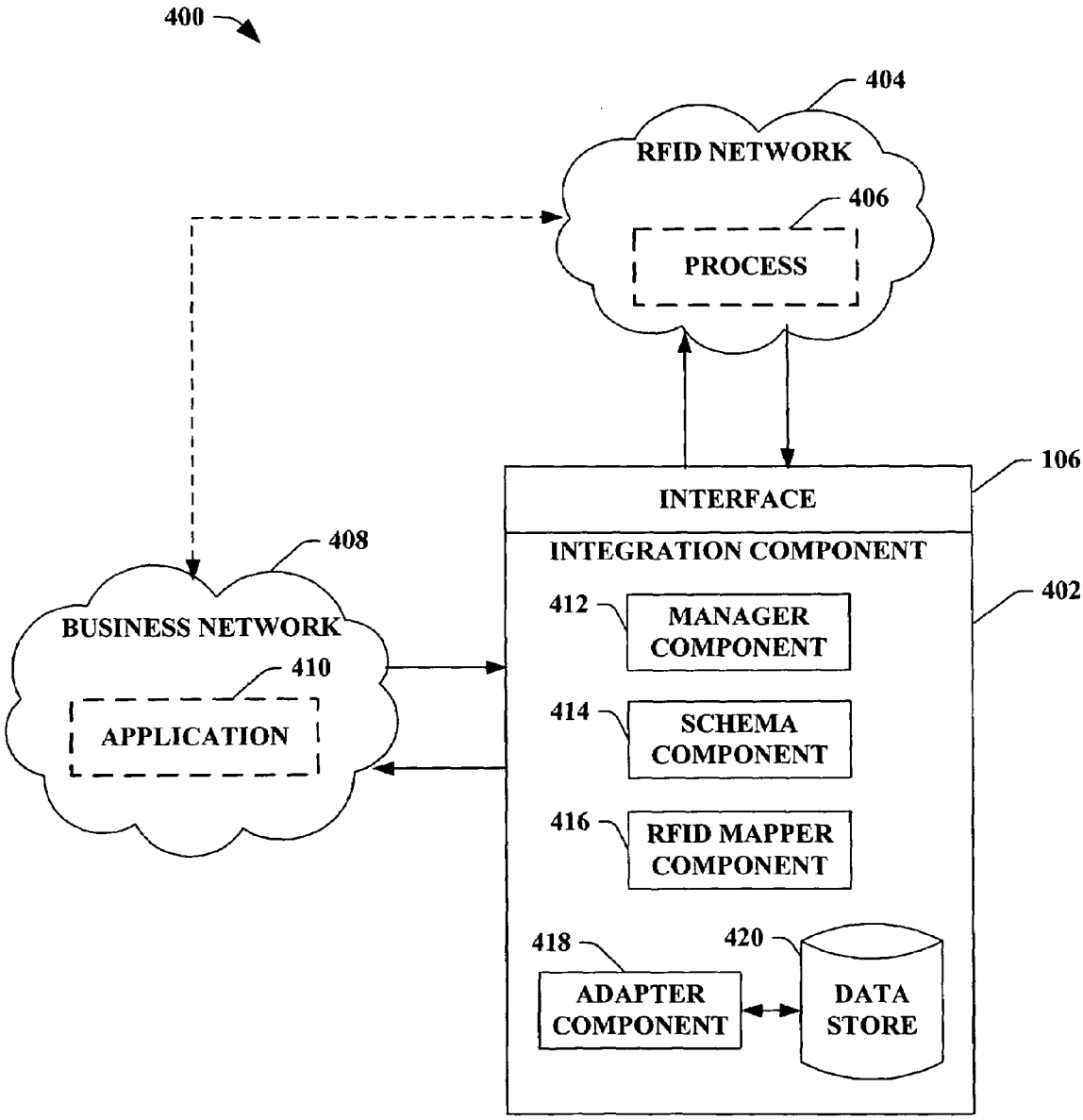
FIG. 4 illustrates a block diagram of an exemplary system that facilitates seamlessly extending data within an RFID network to a business network application.

FIG. 4 illustrates a system 400 that facilitates seamlessly extending data within an RFID network to a business network application. An integration component 402 can integrate at least one business application 410 within a business network 408 into an RFID network 404, wherein data related to at least one process 406 can be utilized by such business network 408 and/or business application 410 (e.g., a back end business application, an existing business application, a line of business (LOB) application (e.g., accounting, supply chain management, resource planning, . . . ), a business activity monitoring (BAM) application, etc.). For instance, the process 406 can collect data via at least one device, wherein such data can be implemented with the business network 408 to achieve various business functions, wherein the business function can be demand planning, forecasting, inventory control, etc. In other words, the integration component 402 can extend the end-point of a process 406 to a business network end-point, allowing cleansed/enriched/relevant real-time RFID data to be natively available for consumption by workflows within the business network 408. It is to be appreciated that the integration component 402, the RFID network 404, and the business network 408 can be substantially similar to respective components/networks described in previous figures.

The integration component 402 can include a manager component 412 that can manage data distribution and/or data routing in the system 400. The manager component 412 can receive raw data from the RFID network 404 and distribute the data to an appropriate target destination within the business network 408 to further be utilized by the application 410. In one example, the manager component can receive data via the interface 106, wherein the data can stored into a data store 420 (discussed infra), wherein such data is accessed accordingly. For example, a device within the RFID network 404 can collect raw data based at least in part upon the process 406, wherein the manager component 412 can store the data in the data store 420 and/or distribute the data to the target destination within the business network 408. It is to be appreciated that the manager can store data within the data store 420 that is being utilized by the business network 408 as well as data that not yet utilized by the business network 408 to provide the possibility of future expansion of the business functions associated therewith. Furthermore, the manager component 412 can distribute data received from the business network 408.

The integration component 402 can include a schema component 414 that can utilize pre-installed schemas relating to input messages and/or output messages. For example, the schema component 414 can utilize an input message schema that can include objects such as, but not limited to, shipping, receiving, inventory, and other input schemas. In addition, the schema component 414 can utilize an output message schema that can include objects such as, but not limited to, advance ship notice, alerts (e.g., out of service, theft, recall, etc.), and other output schemas. Moreover, the schema component 414 can create a schema that can be employed by the system. In one example, such schemas can be utilized in conjunction with data received via the interface 106 from the RFID network 404 to create a particular database. Furthermore, an adapter 418 can transform and/or convert relevant data and pushed into the business network 408 as and when required. By utilizing the schemas, adapter component 418, and the data store 420, raw data from the RFID network 404 can become input data for the business network 408, messaging scenarios, orchestrations, and the like. For instance, this allows a user to directly start utilizing a message without having to write to an adaptive layer (e.g., as native business network 408 message types) and gives the data necessary from a scenario perspective (e.g., shipping data, receiving data, inventory data, etc.). The scenario perspectives can be exposed by the system 400 to be a message type in the business network 408. Furthermore, it is to be appreciated that the message schema can be a type of message that the business network 408 would send out and the RFID network 404 can recognize and/or apply. Although the schema component 414 provides the use of schema for such recognition and application, it is to be appreciated that any suitable protocol can be employed.

For example, an output schema can be stored in the data store related to the business network 408 that allows a business function and/or application to manipulate the RFID network 404. The output schema can enforce the RFID network 404 to write output messages to RFID readers and/or RFID tags (e.g., create a table and "out" messages as native message types that the RFID network 404 can take and send appropriate instructions to devices to tags from these tables, wherein a transfer from business network 408 tables can be initiated to the RFID network 404). The out messages can be composed and/or determined after the execution of a business function related to the business application 410 within the business network 408.

The data store 420 that can store various data related to the system 400. It is to be appreciated that the data store can store data related to the RFID network, data that is transformed and/or converted, schemas, messages, orchestrations, and the like. The data store 420 can be, for example, either volatile memory or nonvolatile memory, or can include both volatile and nonvolatile memory. By way of illustration, and not limitation, nonvolatile memory can include read only memory (ROM), programmable ROM (PROM), electrically programmable ROM (EPROM), electrically erasable programmable ROM (EEPROM), or flash memory. Volatile memory can include random access memory (RAM), which acts as external cache memory. By way of illustration and not limitation, RAM is available in many forms such as static RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), Rambus direct RAM (RDRAM), direct Rambus dynamic RAM (DRDRAM), and Rambus dynamic RAM (RDRAM). The data store 420 of the subject systems and methods is intended to comprise, without being limited to, these and any other suitable types of memory. In addition, it is to be appreciated that the data store 420 can be a server, a database, and/or a hard drive.

The integration component 402 can include an RFID mapper component 416 that enables a straight through message type scenario. The RFID mapper component 416 can utilize an input schema and/or output schema to invoke straight through messaging scenarios for request-response type operations with the application 410 (e.g., back end line of business (LOB) systems, business activity monitoring, etc.). For example, the RFID mapper component 416 can enable the update of an accounting application with inventory based at least in part upon the collected data from the RFID network 404. It is to be appreciated that although the RFID mapper component 416 is incorporated into the integration component 402, such depiction is not so limited on the subject invention.

In one example, the RFID mapper component 416 can invoke any suitable mapping technique associated with data related to the business network 408 and/or the RFID network 404. The RFID mapper component 416 can take, for instance, an RFID tag event (e.g., a tag read, a tag read error, a device up event, a device down event, and a management event, etc.) and create a message related to the process 406 (e.g., shipping and/or receiving). In other words, the RFID mapper component 416 can provide any transformation on data related to the system 400. It is to be appreciated that the business network 408 can include a mapper that allows the mapping associated with a schema, wherein the message schema can be received with an input and apply a map to it to provide a transform message.

Figure 5:
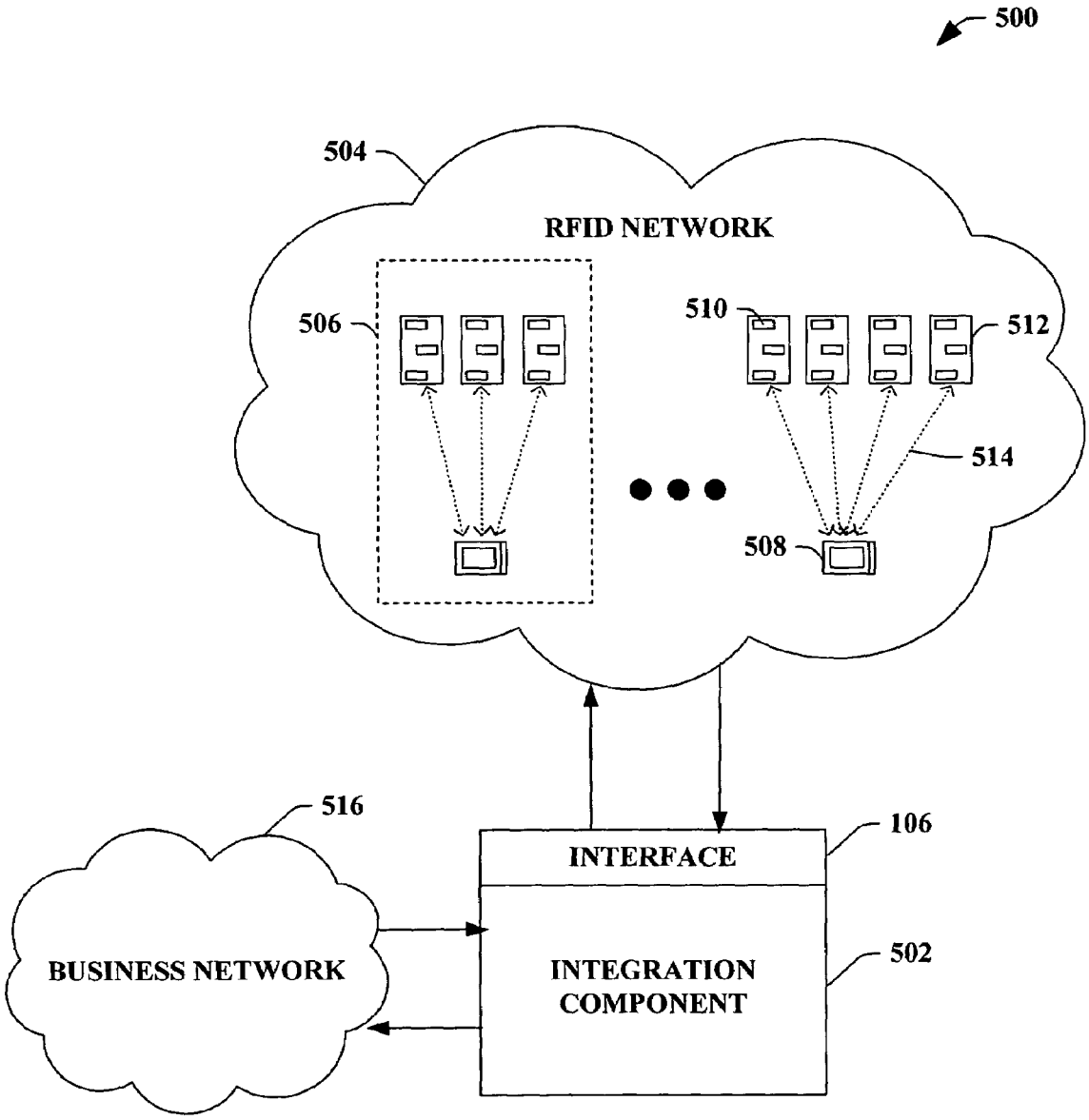
FIG. 5 illustrates a block diagram of an exemplary system that facilitates utilizing a business application related to a business network with an RFID network to achieve a critical business function.

FIG. 5 illustrates a system 500 that facilitates utilizing a business application related to a business network with an RFID network to achieve a critical business function. An integration component 502 can expose any real-time data associated with an RFID network 504 to a business network 516 to achieve real-time business function(s) and/or process (es). In addition, the integration component 502 can allow the business network 516 to manipulate and/or create a process within the RFID network 504 based at least in part upon the output of such real-time business function(s) and/or process (es). It is to be appreciated that the integration component 502, the RFID network 504, and the business network 516 can be substantially similar to respective components/networks described in previous figures.

The RFID network 504 can include a plurality of universes (e.g., subsystems, RFID networks), wherein a universe is a server of RFID entities. For simplicity, the RFID network 504 illustrates a single universe containing two collections of devices (e.g., device collections), where a first collection 506 is shown. For instance, an RFID sub-system can be a location wherein the entities involved are related to a substantially similar process. In one example, a sub-system can be a warehouse containing a plurality of receiving and/or shipping dock doors with associated devices. Thus, first collection 506 can be a collection of devices within the specified sub-system. It is to be appreciated a plurality of collection of devices can be implemented. Within a collection of devices, a device 508 can receive an RFID signal 514 from a pallet of goods 512 containing at least one RFID tag 510. It is to be appreciated the pallets and/or goods can be tagged based at least upon user specifications (e.g., single pallets tagged, individual goods tagged, pallets and goods tagged, etc.).

Based upon the above RFID network 504, the business network 516 can utilize any real-time data from the device(s). By exposing such data, the business network 516 can allow any business function, application, and/or process to execute in real-time since the data received from the RFID network 504 is collected in real-time. In one example, the business network 516 can utilize a line of business application that provides inventory control. By exposing the real-time data from the RFID network 504 to the business network 516, the inventory control application can achieve real-time results. Moreover, the business network 516 can execute functions, applications, and/or processes from which any result can influence and/or create a process within the RFID network. Following the previous example, the inventory control application can manipulate and/or create a process based on the result from utilizing the real-time data.

Figure 6:
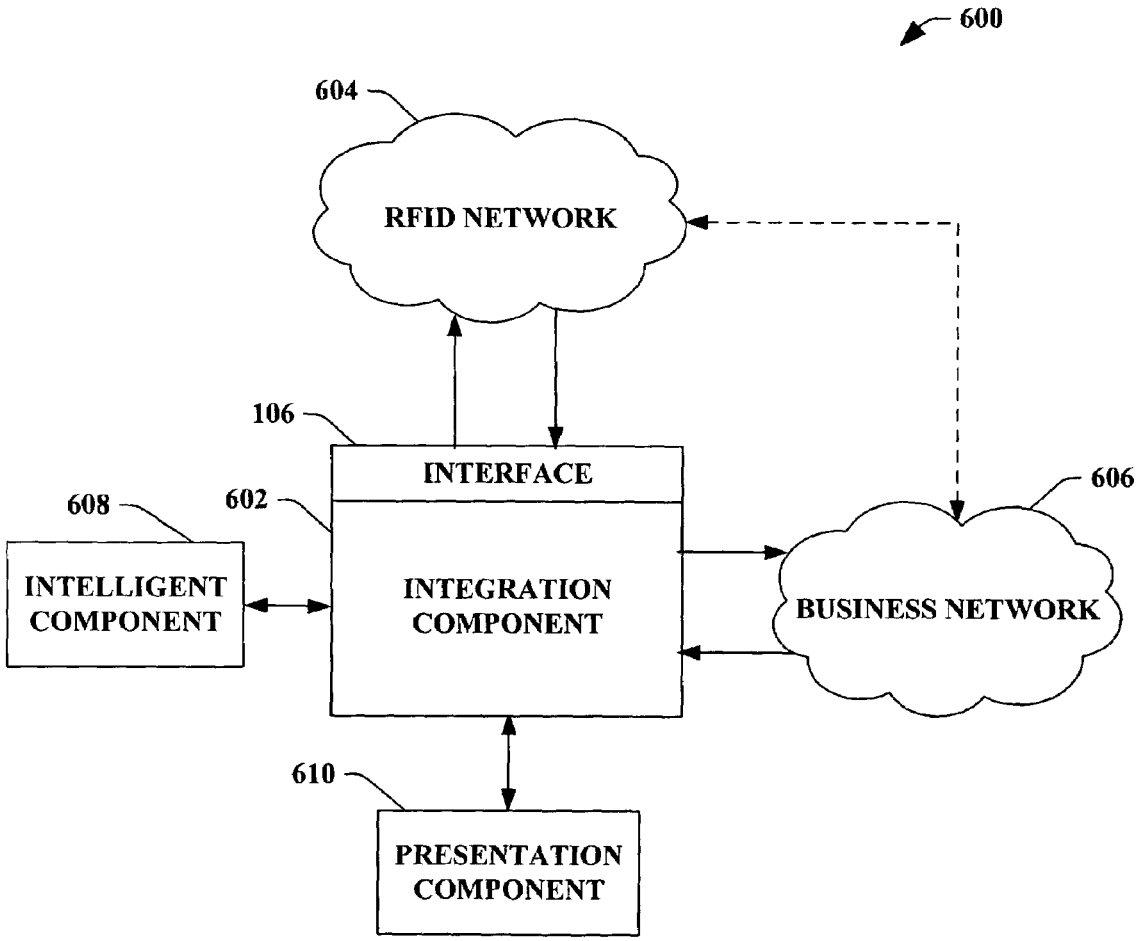
FIG. 6 illustrates a block diagram of an exemplary system that facilitates utilizing and/or managing collected data associated with an RFID network in conjunction with a business network.

FIG. 6 illustrates a system 600 that employs intelligence to facilitate integrating a business application into an RFID network by allowing the utilization of data collected within the RFID network and manipulation of such RFID network. The system 600 can include an integration component 602, an RFID network 604, a business network 606, and an interface 106 that can all be substantially similar to respective components/networks described in previous figures. The system 600 further includes an intelligent component 608. The intelligent component 608 can be utilized by the integration component 602 to facilitate integrating the business network 606 into the RFID network 604. The integration can provide the utilization of data with the business network 606 and/or the manipulation of the RFID network 604 based at least in part upon the output of the business network 606.

It is to be understood that the intelligent component 608 can provide for reasoning about or infer states of the system, environment, and/or user from a set of observations as captured via events and/or data. Inference can be employed to identify a specific context or action, or can generate a probability distribution over states, for example. The inference can be probabilistic—that is, the computation of a probability distribution over states of interest based on a consideration of data and events. Inference can also refer to techniques employed for composing higher-level events from a set of events and/or data. Such inference results in the construction of new events or actions from a set of observed events and/or stored event data, whether or not the events are correlated in close temporal proximity, and whether the events and data come from one or several event and data sources. Various classification (explicitly and/or implicitly trained) schemes and/or systems (e.g., support vector machines, neural networks, expert systems, Bayesian belief networks, fuzzy logic, data fusion engines . . . ) can be employed in connection with performing automatic and/or inferred action in connection with the subject invention.

A classifier is a function that maps an input attribute vector, x=(x1, x2, x3, x4, xn), to a confidence that the input belongs to a class, that is, f(x)=confidence(class). Such classification can employ a probabilistic and/or statistical-based analysis (e.g., factoring into the analysis utilities and costs) to prognose or infer an action that a user desires to be automatically performed. A support vector machine (SVM) is an example of a classifier that can be employed. The SVM operates by finding a hypersurface in the space of possible inputs, which hypersurface attempts to split the triggering criteria from the non-triggering events. Intuitively, this makes the classification correct for testing data that is near, but not identical to training data. Other directed and undirected model classification approaches include, e.g., naïve Bayes, Bayesian networks, decision trees, neural networks, fuzzy logic models, and probabilistic classification models providing different patterns of independence can be employed. Classification as used herein also is inclusive of statistical regression that is utilized to develop models of priority.

A presentation component 610 can provide various types of user interfaces to facilitate interaction between a user and any component coupled to the integration component 602. As depicted, the presentation component 610 is a separate entity that can be utilized with the integration component 602. However, it is to be appreciated that the presentation component 610 and/or similar view components can be incorporated into the integration component 602 and/or a stand-alone unit. The presentation component 610 can provide one or more graphical user interfaces (GUIs), command line interfaces, and the like. For example, a GUI can be rendered that provides a user with a region or means to load, import, read, etc., data, and can include a region to present the results of such. These regions can comprise known text and/or graphic regions comprising dialogue boxes, static controls, dropdown-menus, list boxes, pop-up menus, as edit controls, combo boxes, radio buttons, check boxes, push buttons, and graphic boxes. In addition, utilities to facilitate the presentation such vertical and/or horizontal scroll bars for navigation and toolbar buttons to determine whether a region will be viewable can be employed. For example, the user can interact with one or more of the components coupled to the integration component 602.

The user can also interact with the regions to select and provide information via various devices such as a mouse, a roller ball, a keypad, a keyboard, a pen and/or voice activation, for example. Typically, a mechanism such as a push button or the enter key on the keyboard can be employed subsequent entering the information in order to initiate the search. However, it is to be appreciated that the invention is not so limited. For example, merely highlighting a check box can initiate information conveyance. In another example, a command line interface can be employed. For example, the command line interface can prompt (e.g., via a text message on a display and an audio tone) the user for information via providing a text message. The user can than provide suitable information, such as alpha-numeric input corresponding to an option provided in the interface prompt or an answer to a question posed in the prompt. It is to be appreciated that the command line interface can be employed in connection with a GUI and/or API. In addition, the command line interface can be employed in connection with hardware (e.g., video cards) and/or displays (e.g., black and white, and EGA) with limited graphic support, and/or low bandwidth communication channels.

Figure 7:
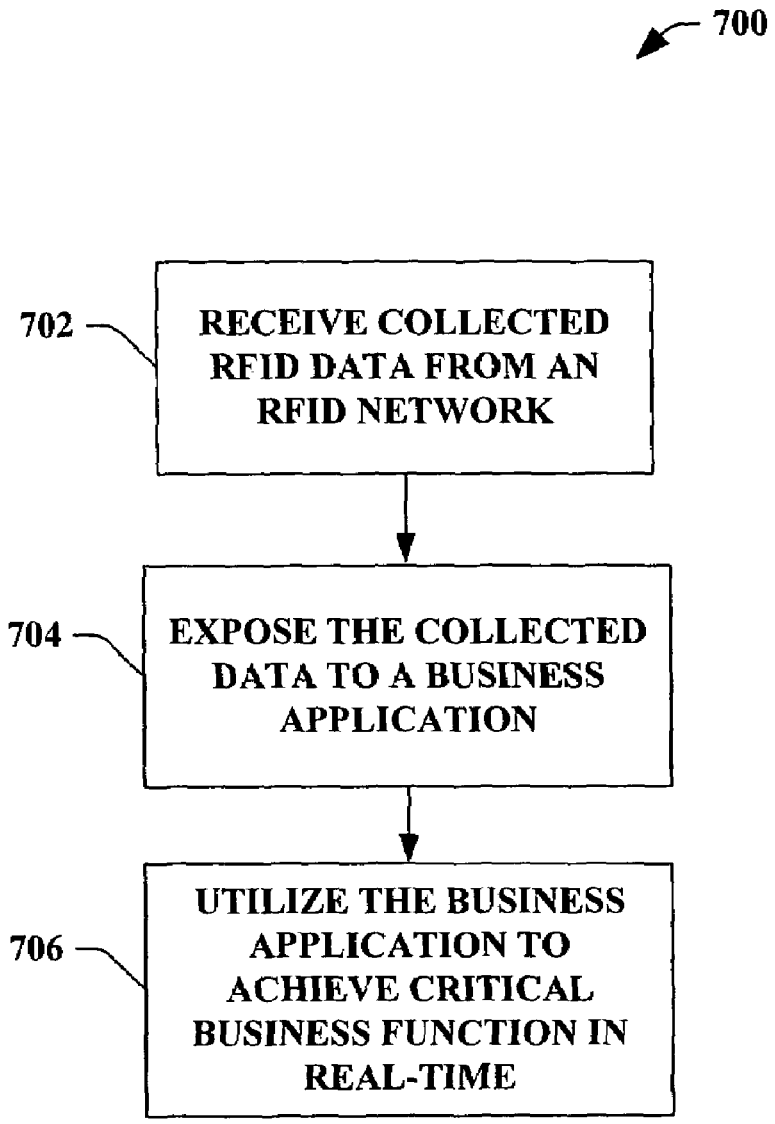
FIG. 7 illustrates an exemplary methodology for integrating at least one existing business application into an RFID network.
Figure 8:
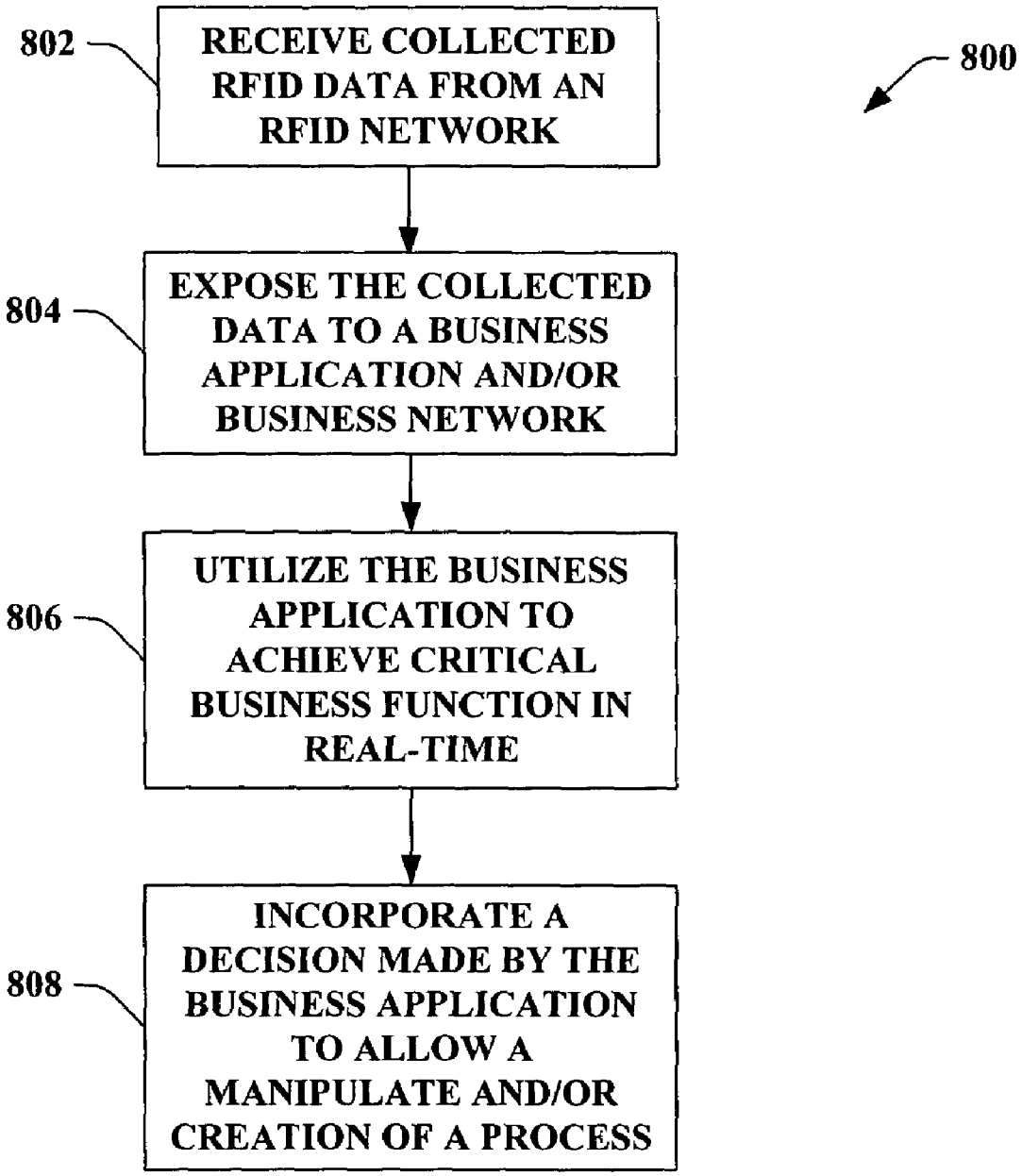
FIG. 8 illustrates an exemplary methodology that facilitates seamlessly extending data within an RFID network to a business network application.

FIGS. 7-8 illustrate methodologies in accordance with the subject invention. For simplicity of explanation, the methodologies are depicted and described as a series of acts. It is to be understood and appreciated that the subject invention is not limited by the acts illustrated and/or by the order of acts, for example acts can occur in various orders and/or concurrently, and with other acts not presented and described herein. Furthermore, not all illustrated acts may be required to implement the methodologies in accordance with the subject invention. In addition, those skilled in the art will understand and appreciate that the methodologies could alternatively be represented as a series of interrelated states via a state diagram or events.

FIG. 7 illustrates a methodology 700 for integrating at least one existing business application into an RFID network. At reference numeral 702, real-time data can be collected from a device within an RFID network. It is to be appreciated that the device can be, but is not limited to, an RFID reader, an RFID writer, an RFID printer, a printer, a reader, a writer, an RFID transmitter, an antenna, a sensor, a real-time device, an RFID receiver, a real-time sensor, a device extensible to a web service, and a real-time event generation system.

Moreover, the RFID network includes various sub-systems based at least in part upon location, function, and/or process. The RFID network can include at least one device that is associated with at least one RFID process. In another example, the RFID network contains a plurality of universes (e.g., sub-systems, RFID networks), wherein a universe is a server of RFID entities. For instance, an RFID sub-system can be a location wherein the entities involved are related to a substantially similar process. In one example, a sub-system can be a warehouse having a plurality of receiving and/or shipping dock doors with associated devices.

At reference numeral 704, the collected data can be exposed to a business application. The data can be formatted and/or converted into a suitable format allowing the seamless integration into a business application. The business application can be, but is not limited to, a back end application, an existing business application, a line of business (LOB) application (e.g., accounting, supply chain management, resource planning, . . . ), a business activity monitoring (BAM) application, etc. Moreover, the business application can be associated with a business network, wherein the business network provides the unity of separate business applications into a coherent whole. At reference numeral 706, the business application can utilize the real-time data from the RFID network to provide real-time outputs from such business applications. By implementing real-time data from the RFID network to business applications, the results and/or function yield accurate interpretations and/or analysis.

FIG. 8 illustrates a methodology 800 that facilitates seamlessly extending data within an RFID network to a business network application. At reference numeral 802, collected RFID data is received from a device within an RFID network. The RFID network can include at least one device that is associated with at least one RFID process, wherein the device can be, but is not limited to, an RFID reader, an RFID writer, an RFID printer, a printer, a reader, a writer, an RFID transmitter, an antenna, a sensor, a real-time device, an RFID receiver, a real-time sensor, a device extensible to a web service, and a real-time event generation system.

At reference numeral 804, the collected data can be exposed to a business application and/or a business network. The business application can be, for instance, a back end application, an existing business application, a line of business (LOB) application (e.g., accounting, supply chain management, resource planning, . . . ), a business activity monitoring (BAM) application, etc. The business network can be an integration server product that enables the development, deployment, and/or management of an integrated business process and/or extensible markup language (XML) based Web service. The business network can unite separate applications into a coherent whole, wherein a deep integration between messaging, orchestration, security, and support for industry standards can be provided. In addition, the business network can enable the creation of a business process that spans multiple applications by providing: 1) a manner to specify the business process; and 2) a technique for communicating between applications that such business processes utilize.

At reference numeral 806, the business application and/or business network can utilize the exposed data to achieve real-time business functions and/or analysis. By utilizing the real-time data, the business applications and/or business network can provide more meaningful results based on the accuracy of the input data. Thus, an end point to a process within the RFID network can be extended to a business network and/or business application to allow the cleansed/enriched/relevant real-time RFID data to be natively available for consumption by a workflow in the business network. It is to be appreciated that the seamless integration of data from the RFID network can include various transformations, schemas, adapters, routers, mappers, messages, and the like as depicted above. At reference numeral 808, the decision/output and/or results can be utilized to base a manipulation and/or creation of a process within the RFID network. For example, based upon the real-time analysis and/or business functions (via real-time data exposure), the RFID network and/or processes can be edited, modified, deleted, and/or created accordingly.

Figure 9:
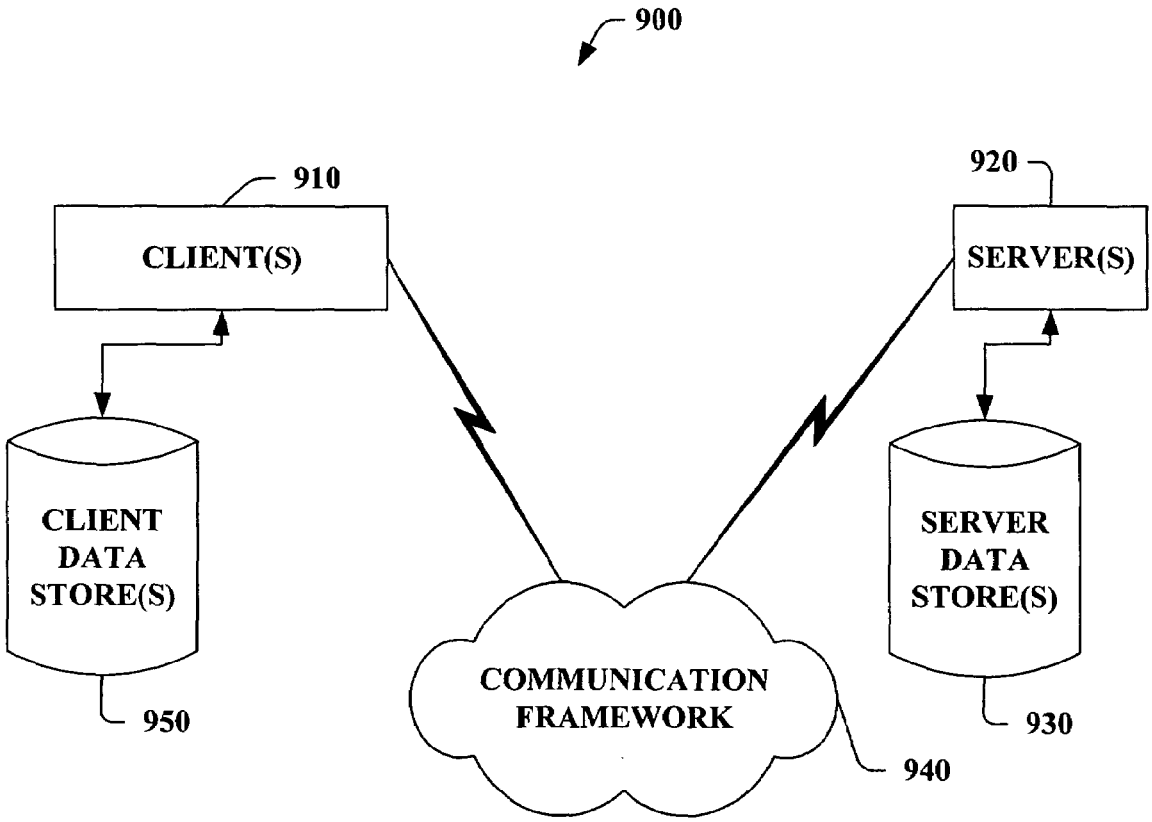
FIG. 9 illustrates an exemplary networking environment, wherein the novel aspects of the subject invention can be employed.
Figure 10:
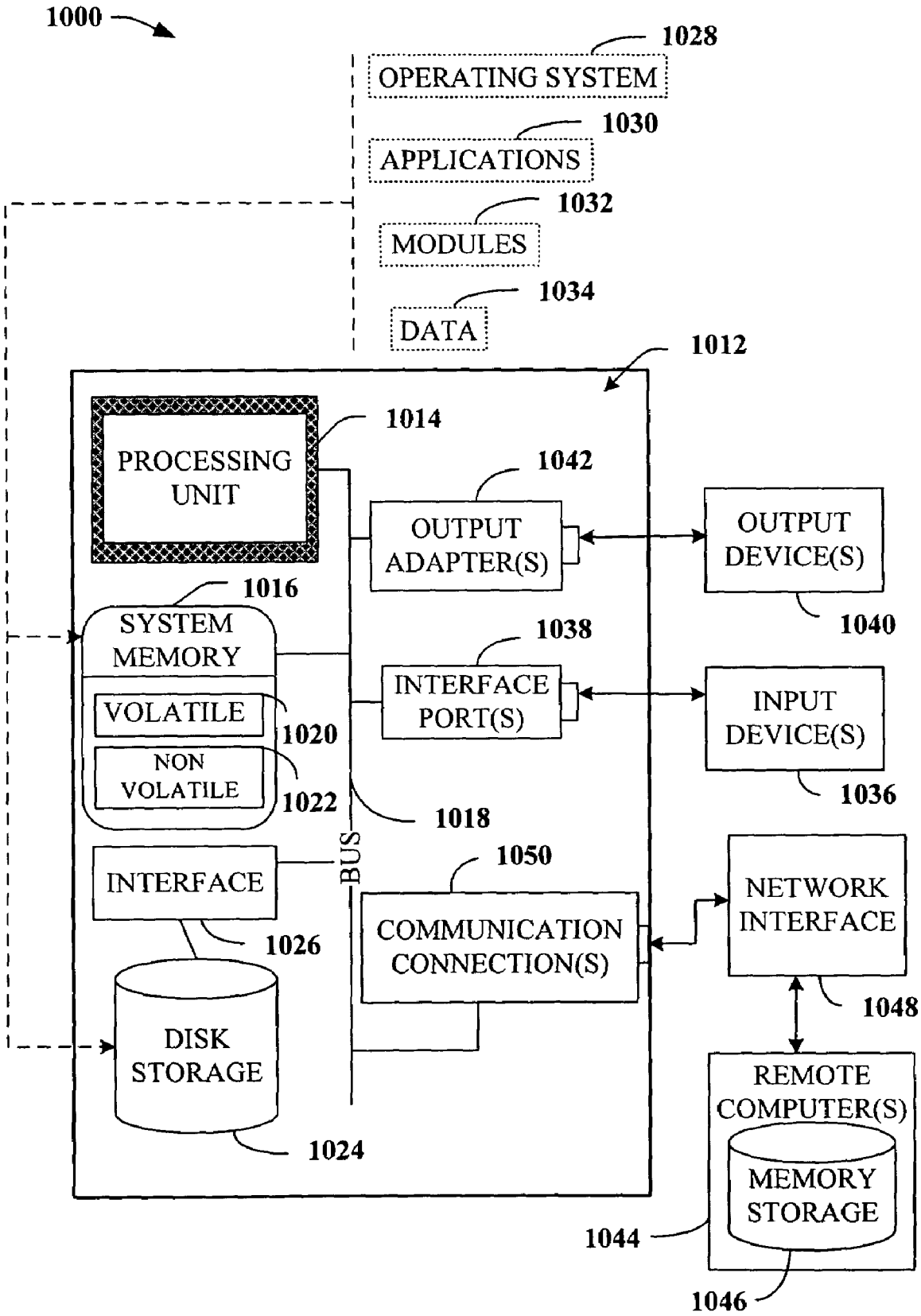
FIG. 10 illustrates an exemplary operating environment that can be employed in accordance with the subject invention.

In order to provide additional context for implementing various aspects of the subject invention, FIGS. 9-10 and the following discussion is intended to provide a brief, general description of a suitable computing environment in which the various aspects of the subject invention may be implemented. While the invention has been described above in the general context of computer-executable instructions of a computer program that runs on a local computer and/or remote computer, those skilled in the art will recognize that the invention also may be implemented in combination with other program modules. Generally, program modules include routines, programs, components, data structures, etc., that perform particular tasks and/or implement particular abstract data types.

Moreover, those skilled in the art will appreciate that the inventive methods may be practiced with other computer system configurations, including single-processor or multiprocessor computer systems, minicomputers, mainframe computers, as well as personal computers, hand-held computing devices, microprocessor-based and/or programmable consumer electronics, and the like, each of which may operatively communicate with one or more associated devices. The illustrated aspects of the invention may also be practiced in distributed computing environments where certain tasks are performed by remote processing devices that are linked through a communications network. However, some, if not all, aspects of the invention may be practiced on stand-alone computers. In a distributed computing environment, program modules may be located in local and/or remote memory storage devices.

FIG. 9 is a schematic block diagram of a sample-computing environment 900 with which the subject invention can interact. The system 900 includes one or more client(s) 910. The client(s) 910 can be hardware and/or software (e.g., threads, processes, computing devices). The system 900 also includes one or more server(s) 920. The server(s) 920 can be hardware and/or software (e.g., threads, processes, computing devices). The servers 920 can house threads to perform transformations by employing the subject invention, for example.

One possible communication between a client 910 and a server 920 can be in the form of a data packet adapted to be transmitted between two or more computer processes. The system 900 includes a communication framework 940 that can be employed to facilitate communications between the client(s) 910 and the server(s) 920. The client(s) 910 are operably connected to one or more client data store(s) 950 that can be employed to store information local to the client(s) 910. Similarly, the server(s) 920 are operably connected to one or more server data store(s) 930 that can be employed to store information local to the servers 920.

With reference to FIG. 10, an exemplary environment 1000 for implementing various aspects of the invention includes a computer 1012. The computer 1012 includes a processing unit 1014, a system memory 1016, and a system bus 1018. The system bus 1018 couples system components including, but not limited to, the system memory 1016 to the processing unit 1014. The processing unit 1014 can be any of various available processors. Dual microprocessors and other multiprocessor architectures also can be employed as the processing unit 1014.

The system bus 1018 can be any of several types of bus structure(s) including the memory bus or memory controller, a peripheral bus or external bus, and/or a local bus using any variety of available bus architectures including, but not limited to, Industrial Standard Architecture (ISA), Micro-Channel Architecture (MSA), Extended ISA (EISA), Intelligent Drive Electronics (IDE), VESA Local Bus (VLB), Peripheral Component Interconnect (PCI), Card Bus, Universal Serial Bus (USB), Advanced Graphics Port (AGP), Personal Computer Memory Card International Association bus (PCMCIA), Firewire (IEEE 1394), and Small Computer Systems Interface (SCSI).

The system memory 1016 includes volatile memory 1020 and nonvolatile memory 1022. The basic input/output system (BIOS), containing the basic routines to transfer information between elements within the computer 1012, such as during start-up, is stored in nonvolatile memory 1022. By way of illustration, and not limitation, nonvolatile memory 1022 can include read only memory (ROM), programmable ROM (PROM), electrically programmable ROM (EPROM), electrically erasable programmable ROM (EEPROM), or flash memory. Volatile memory 1020 includes random access memory (RAM), which acts as external cache memory. By way of illustration and not limitation, RAM is available in many forms such as static RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), Rambus direct RAM (RDRAM), direct Rambus dynamic RAM (DRDRAM), and Rambus dynamic RAM (RDRAM).

Computer 1012 also includes removable/non-removable, volatile/nonvolatile computer storage media. FIG. 10 illustrates, for example a disk storage 1024. Disk storage 1024 includes, but is not limited to, devices like a magnetic disk drive, floppy disk drive, tape drive, Jaz drive, Zip drive, LS-100 drive, flash memory card, or memory stick. In addition, disk storage 1024 can include storage media separately or in combination with other storage media including, but not limited to, an optical disk drive such as a compact disk ROM device (CD-ROM), CD recordable drive (CD-R Drive), CD rewritable drive (CD-RW Drive) or a digital versatile disk ROM drive (DVD-ROM). To facilitate connection of the disk storage devices 1024 to the system bus 1018, a removable or non-removable interface is typically used such as interface 1026.

It is to be appreciated that FIG. 10 describes software that acts as an intermediary between users and the basic computer resources described in the suitable operating environment 1000. Such software includes an operating system 1028. Operating system 1028, which can be stored on disk storage 1024, acts to control and allocate resources of the computer system 1012. System applications 1030 take advantage of the management of resources by operating system 1028 through program modules 1032 and program data 1034 stored either in system memory 1016 or on disk storage 1024. It is to be appreciated that the subject invention can be implemented with various operating systems or combinations of operating systems.

A user enters commands or information into the computer 1012 through input device(s) 1036. Input devices 1036 include, but are not limited to, a pointing device such as a mouse, trackball, stylus, touch pad, keyboard, microphone, joystick, game pad, satellite dish, scanner, TV tuner card, digital camera, digital video camera, web camera, and the like. These and other input devices connect to the processing unit 1014 through the system bus 1018 via interface port(s) 1038. Interface port(s) 1038 include, for example, a serial port, a parallel port, a game port, and a universal serial bus (USB). Output device(s) 1040 use some of the same type of ports as input device(s) 1036. Thus, for example, a USB port may be used to provide input to computer 1012, and to output information from computer 1012 to an output device 1040. Output adapter 1042 is provided to illustrate that there are some output devices 1040 like monitors, speakers, and printers, among other output devices 1040, which require special adapters. The output adapters 1042 include, by way of illustration and not limitation, video and sound cards that provide a means of connection between the output device 1040 and the system bus 1018. It should be noted that other devices and/or systems of devices provide both input and output capabilities such as remote computer(s) 1044.

Computer 1012 can operate in a networked environment using logical connections to one or more remote computers, such as remote computer(s) 1044. The remote computer(s) 1044 can be a personal computer, a server, a router, a network PC, a workstation, a microprocessor based appliance, a peer device or other common network node and the like, and typically includes many or all of the elements described relative to computer 1012. For purposes of brevity, only a memory storage device 1046 is illustrated with remote computer(s) 1044. Remote computer(s) 1044 is logically connected to computer 1012 through a network interface 1048 and then physically connected via communication connection 1050. Network interface 1048 encompasses wire and/or wireless communication networks such as local-area networks (LAN) and wide-area networks (WAN). LAN technologies include Fiber Distributed Data Interface (FDDI), Copper Distributed Data Interface (CDDI), Ethernet, Token Ring and the like. WAN technologies include, but are not limited to, point-to-point links, circuit switching networks like Integrated Services Digital Networks (ISDN) and variations thereon, packet switching networks, and Digital Subscriber Lines (DSL).

Communication connection(s) 1050 refers to the hardware/software employed to connect the network interface 1048 to the bus 1018. While communication connection 1050 is shown for illustrative clarity inside computer 1012, it can also be external to computer 1012. The hardware/software necessary for connection to the network interface 1048 includes, for exemplary purposes only, internal and external technologies such as, modems including regular telephone grade modems, cable modems and DSL modems, ISDN adapters, and Ethernet cards.

What has been described above includes examples of the subject invention. It is, of course, not possible to describe every conceivable combination of components or methodologies for purposes of describing the subject invention, but one of ordinary skill in the art may recognize that many further combinations and permutations of the subject invention are possible. Accordingly, the subject invention is intended to embrace all such alterations, modifications, and variations that fall within the spirit and scope of the appended claims.

In particular and in regard to the various functions performed by the above described components, devices, circuits, systems and the like, the terms (including a reference to a "means") used to describe such components are intended to correspond, unless otherwise indicated, to any component which performs the specified function of the described component (e.g., a functional equivalent), even though not structurally equivalent to the disclosed structure, which performs the function in the herein illustrated exemplary aspects of the invention. In this regard, it will also be recognized that the invention includes a system as well as a computer-readable medium having computer-executable instructions for performing the acts and/or events of the various methods of the invention.

In addition, while a particular feature of the invention may have been disclosed with respect to only one of several implementations, such feature may be combined with one or more other features of the other implementations as may be desired and advantageous for any given or particular application. Furthermore, to the extent that the terms "includes," and "including" and variants thereof are used in either the detailed description or the claims, these terms are intended to be inclusive in a manner similar to the term "comprising."

What is claimed is:

1. A system that facilitates extending data within an RFID network to a business application, comprising:

an interface that receives real-time RFID data from a process comprising of at least one device collection in the RFID network, the process is a high-level object that forms together at least one entity to create a meaningful unit of execution within the RFID network;

an integration component that seamlessly exposes real-time RFID data to a business application to achieve a critical business function in real-time, the business application effectuates a change to the process within the RFID network based at least in part upon the real-time RFID data;

an analyzer component that analyzes data related to at least one of the RFID network and the business application to determine the association of such data to one of a process within the RFID network, the business application, and a business network;

a router component that distributes data to a target destination within at least one of the RFID network, the business application, and a business network; and a transform component that formats data into a particular format suitable for at least one of the RFID network, the business application, and a business network.

2. The system of claim 1, the device collection is a collection of devices, wherein the device is one of the following: an RFID reader; an RFID writer; an RFID printer; a reader; a writer; an RFID transmitter; an antenna; a sensor; a real-time device; an RFID receiver; a real-time sensor; a device extensible to a web service; and a real-time event generation system.

3. The system of claim 1, the business application is at least one of the following: a back end application; an existing business application; a line of business (LOB) application; an accounting application; a supply chain management application; a resource planning application; and a business monitoring (BAM) application.

4. The system of claim 1, the critical business function is one of the following: a demand plan; a forecast; and an inventory control with the incorporation of RFID data in real-time.

5. The system of claim 1, the business application is associated with a business network that enables at least one of a development, a deployment, and a management of one of an integrated business process and a language based Web service, wherein separate applications are united into a coherent whole to allow for at least one of the connection of an application within a single organization and the connection of an application in disparate organizations.

6. The system of claim 1, the business application provides a creation of a process within the RFID network based at least in part upon the real-time RFID data.

7. The system of claim 6, that relates to at least one of the following:

an outbound process; a manufacturing process; a shipping process; a receiving process; a tracking process; a data representation process; a data manipulation process; a security process; and a process utilizing one of an RFID device service, a device collection, a tag read, an event, an event queue, a tag write, a device configuration, and a number count.

8. The system of claim 7, the event is one of the following: a tag read; a tag read error; a device up event; a device down event; and a management event.

9. The system of claim 1, the RFID network comprises a collection of devices that form a sub-system which includes:

an RFID reader that receives an RFID signal; and an RFID tag that transmits to at least one device.

10. The system of claim 1, further comprising an RFID mapper component that enables a straight through message type scenario, wherein a mapping technique is associated with data related to at least one of the application, a business network, and the RFID network.

11. The system of claim 1, further comprising a schema component that invokes at least one of the following: 1) a schema and a protocol that relates to at least one of an input message and an output message; and 2) the creation of a schema.

12. The system of claim 11, the schema component further provides a message schema, specified by a business network, that is a type of message that the business network can transmit, wherein the RFID network can recognize and apply.

13. A computer-implemented method that facilitates extending data within an RFID network to a business application, comprising:

receiving at an interface real-time data from an RFID network based at least in part on a process within the RFID network, the process is a high-level object that forms together at least one entity to create a meaningful unit of execution within the RFID network;

exposing the real-time data to a business application via business network;

utilizing the real-time data with the business application to achieve a critical business function in real-time;

effectuating a change to the process within the RFID network based on the real-time data via the business application; and analyzing data related to at least one of the RFID network and the business application to determine the association of such data to one of a process within the RFID network, the business application, and a business network.

14. The method of claim 13, further comprising:

transforming the real-time data to a compatible format;

routing the data to an appropriate target destination;

conforming the data to a message schema;

exposing the real-time data to a business network;

creating a process within the RFID network based on the real-time output; and invoking a straight through messaging type scenario.

15. A computer-implemented system that facilitates extending data within an RFID network to a business application, comprising:

means for receiving real-time RFID data from a process comprising at least one device collection within the RFID network, the process is a high-level object that forms together at least one entity to create a meaningful unit of execution within the RFID network;

means for seamlessly exposing real-time RFID data to a business application to achieve a critical business function in real-time;

means for modifying the process based at least in part upon the critical business function real-time output; and means for analyzing data related to at least one of the RFID network and the business application to determine the association of such data to one of a process within the RFID network, the business application, and a business network.

* * * * *